US010081893B2

(12) United States Patent
Makover et al.

(10) Patent No.: US 10,081,893 B2
(45) Date of Patent: Sep. 25, 2018

(54) COMPUTER-CONTROLLED SEWING MACHINE POSITIONING SYSTEM INTEGRATED WITH PROCESSING DEVICE, AND POSITIONING METHOD THEREOF

(71) Applicant: ORISOL ASIA LTD., Chang Hwa (CN)

(72) Inventors: Jakov Makover, Maccabim (IL); Bar Cochva Mardix, Tel Aviv (IL); Yaacov Sadeh, Rechovot (IL)

(73) Assignee: ORISOL ASIA LTD., Chang Hwa (CN)

( * ) Notice: Subject to any disclaimer, the term of this patent is extended or adjusted under 35 U.S.C. 154(b) by 45 days.

(21) Appl. No.: 15/311,838

(22) PCT Filed: Jun. 11, 2014

(86) PCT No.: PCT/CN2014/079661

§ 371 (c)(1),
(2) Date: Nov. 16, 2016

(87) PCT Pub. No.: WO2015/188328

PCT Pub. Date: Dec. 17, 2015

(65) Prior Publication Data

US 2017/0096756 A1 Apr. 6, 2017

(51) Int. Cl.
*D05B 21/00* (2006.01)
*D05B 19/16* (2006.01)

(52) U.S. Cl.
CPC ..... *D05B 19/16* (2013.01); *D05B 21/00* (2013.01)

(58) Field of Classification Search
CPC ..... D05B 21/00; D05B 39/00; D05B 23/00
See application file for complete search history.

(56) References Cited

U.S. PATENT DOCUMENTS 3,329,109 A * 7/1967 Portnoff ..... D05B 21/00 112/102
4,406,234 A * 9/1983 Johnson ..... D05B 21/00 112/470.18

(Continued)

*Primary Examiner* — Tejash Patel
(74) *Attorney, Agent, or Firm* — Bruce Stone LLP; Joseph Bruce

(57) ABSTRACT

A computer-controlled sewing machine positioning system integrated with a processing device (50), and positioning method thereof, fixedly disposing at least one processing device (50) at one side of the sewing head (41) of a computer-controlled sewing machine (40); movement of the processing device (50) is controlled by a processing program of the computer-controlled sewing machine (40); a relative distance is provided between the processing head (51) of the processing device (50) and the sewing head (41) to give the movement range of a conveying mechanism (20) to extend to covered positions below the sewing head (41) and the processing head (51), such that a fixing mechanism (30) is moved and feeds below the sewing head (41) and the processing head (51); and presetting a positioning distance between two positioning parts (33, 34) of the fixing mechanism (30) and the relative distances in the processing program, thus automatically determining the feed distance of the fixing mechanism (30) between the sewing head (41) and the processing head (51), improving sewing and processing precision and production efficiency, and reducing the size and cost of the device.

7 Claims, 7 Drawing Sheets

(56) References Cited

U.S. PATENT DOCUMENTS

| | | | | | |
|---|---|---|---|---|---|
| 4,512,269 | A * | 4/1985 | Bowditch | D05B 33/00 | 112/147 |
| 4,883,006 | A * | 11/1989 | Marii | D05B 21/00 | 112/470.07 |
| 4,998,964 | A * | 3/1991 | Golia | D05B 21/00 | 112/102.5 |
| 5,553,565 | A * | 9/1996 | Ono | D05B 21/00 | 112/470.18 |
| 2012/0291683 | A1 * | 11/2012 | Lee | D05B 3/24 | 112/470.05 |

* cited by examiner

COMPUTER-CONTROLLED SEWING MACHINE POSITIONING SYSTEM INTEGRATED WITH PROCESSING DEVICE, AND POSITIONING METHOD THEREOF

BACKGROUND

Field of the Invention

The present invention relates to a positioning system and method for a computer-controlled sewing machine, and more particularly to a computer-controlled sewing machine positioning system integrated with a processing device, and positioning method thereof Related Prior Art The computer-controlled sewing machine has found wide application in industry due to its improved processing accuracy and production efficiency. The computer-controlled sewing machine includes a clamping device to fix a to-be-processed object to a plane, and then the sewing head of the sewing machine performs sewing on the to-be-processed object according to the sewing program set in the computer.

It is to be noted that, prior to being made into the final product, the to-be-processed object has to go through multiple processing steps, such as application of cement, holes punching, inserting of decorative or functional eyelets, and etc, which are the steps need to be performed at specific positions on a sewing machine The inserting of eyelets, for example, is a processing operation commonly used in industry, and is usually performed by manual labor, namely, the to-be-sewed object is manually moved to a work position below the eyelet inserting head, and then the processing step of inserting of eyelets is performed. The existing computer-controlled eyelet inserting machine is only capable of automatically performing eyelet inserting process by using computer program.

Currently, the above processing steps are carried out separately by respective independent processing machines, and each of the independent processing machines has to be equipped with a clamping device to clamp the to-be-processed object. For example, between the sewing step and the eyelet inserting step, the to-be-processed object must be taken off from the clamping device of the processing machine used in the prior processing step and then manually moved to and clamped by the clamping device of the processing machine used in the next processing step. The movement of the to-be-process object between processing steps is likely to cause dislocation of the to-be-processed object, consequently leading to reduction in processing accuracy.

Therefore, a computer-controlled sewing machine positioning system integrated with a processing device, and positioning method thereof is necessary to integrate all the above processing into one, wherein a computer program in a design phase integrates the operation instructions of all the processing steps. The computerized sewing is integrated with other equipments, such as the eyelet inserting mechanism, and uses one and the same clamping device to clamp the to-be-processed object when performing the above processing steps, and all the processing steps are controlled by one and the same computer program.

The present invention has arisen to mitigate and/or obviate the afore-described disadvantages.

SUMMARY

The present invention is aimed at providing a computer-controlled sewing machine positioning system integrated with a processing device, and positioning method thereof, wherein at least one processing device is fixed at one side of the sewing head of the computer-controlled sewing machine The processing device is controlled by the processing program of the computer-controlled sewing machine, movement of the processing device is controlled by a processing program of the computer-controlled sewing machine; a relative distance is provided between the processing head of the processing device and the sewing head to give the movement range of a conveying mechanism to extend to covered positions below the sewing head and the processing head, such that a fixing mechanism is moved and feeds below the sewing head and the processing head; and presetting a positioning distance between two positioning parts of the fixing mechanism and the relative distances in the processing program, thus automatically determining the feed distance of the fixing mechanism between the sewing head and the processing head, improving sewing and processing precision and production efficiency, and reducing the size and cost of the device.

A computer-controlled sewing machine positioning system integrated with a processing device, in accordance with the present invention comprises: a work platform including a top surface, an opposite bottom surface, and a positioning mechanism disposed on the top surface; a conveying mechanism disposed at one side of the work platform, and including a first slide rail assembly extending in a direction X and a second slide rail assembly extending in a direction Y, a clamping device being disposed at one end of the second slide rail assembly facing the work platform; a computer-controlled sewing machine disposed on the work platform and including a processing program, and further including a sewing head which is disposed above the top surface of the work platform; at least one processing device disposed on the work platform, and including a processing head, a relative distance being provided between the processing head and the sewing head and located along the work platform; and a fixing mechanism serving to fix an object to be sewn, and including a rod extending in the direction X and a support plate which has a lateral edge fixed to the rod, the rod being provided at two ends thereof with a first positioning part and a second positioning portion, and a positioning distance being provided between the first and second positioning portions; wherein the positioning mechanism, the conveying mechanism, the clamping device and the processing device are electrically connected to the computer-controlled sewing machine and controlled to operate by the processing program, the processing program controls the positioning mechanism to fix the fixing mechanism to the work platform and make the clamping device selectively clamp the first positioning part or the second positioning portion, and the fixing mechanism is driven by the conveying mechanism to move on the work platform, so that the processing program is able to calculate a movement distance of the fixing mechanism between the sewing head or the processing head by using the positioning distance and the relative distance.

A positioning method of the computer-controlled sewing machine positioning system is used in the sewing operation and the processing procedures integrated with the sewing operation, and comprises: a step of defining the relative distance including: locating the processing device in a position which is precisely defined and located at a distance from the sewing head of the computer-controlled sewing machine, defining a distance between the processing head and the sewing head along the work platform as the relative distance, and presetting the relative distance in the processing program of the computer-controlled sewing machine; a step of defining the positioning distance including: presetting the first positioning part and the second positioning part on the rod of the fixing mechanism, defining a distance between the first and second positioning parts as the positioning distance, presetting the positioning distance in the processing program of the computer-controlled sewing machine; a step of positioning in sewing-operation including: using the clamping device to clamp the first positioning part of the fixing mechanism, abutting the fixing mechanism against the support bracket, moving, by the conveying mechanism, the fixing mechanism to a position below the sewing head; and a step of positioning in processing procedures including: sending, by the processing program, an instruction to the conveying mechanism to make the clamping device clamp against the fixing mechanism when the processing program determines the positioning distance with respect to the relative distance, finding coordinates where the relative distance and the positioning distance are equal, so that, based on the coordinates, the fixing mechanism is moved from the position below the sewing head to a position below the processing head to perform processing procedures.

The step of positioning in sewing-operation and the step of positioning in processing procedures can be swapped, there is a method for changing the position of the fixing mechanism between the step of positioning in sewing-operation and the step of positioning in processing procedures, the method for changing the position of the fixing mechanism including:

turning on the positioning mechanism, when the clamping device clamps one of the first and second positioning portions, to fix the fixing mechanism to the work platform;

making the clamping device release the one of the first and second positioning portions;

moving, by the conveying mechanism, the clamping device in the direction Y to release from the fixing mechanism, moving the clamping device in the direction X to another one of the first and second positioning portions, moving the clamping device in the direction Y to the another one of the first and second positioning portions;

making the clamping device clamp the another one of the first and second positioning portions, making the positioning mechanism stop working, so that the fixing mechanism is allowed to be driven by the clamping device and the conveying mechanism to move on the work platform.

BRIEF DESCRIPTION OF THE DRAWINGS

FIGS. 4-1-4-4 are illustrative views showing the movement of the clamping device of the computer-controlled sewing machine of the present invention.

DESCRIPTION OF REFERENCE NUMERALS

Figure 1:
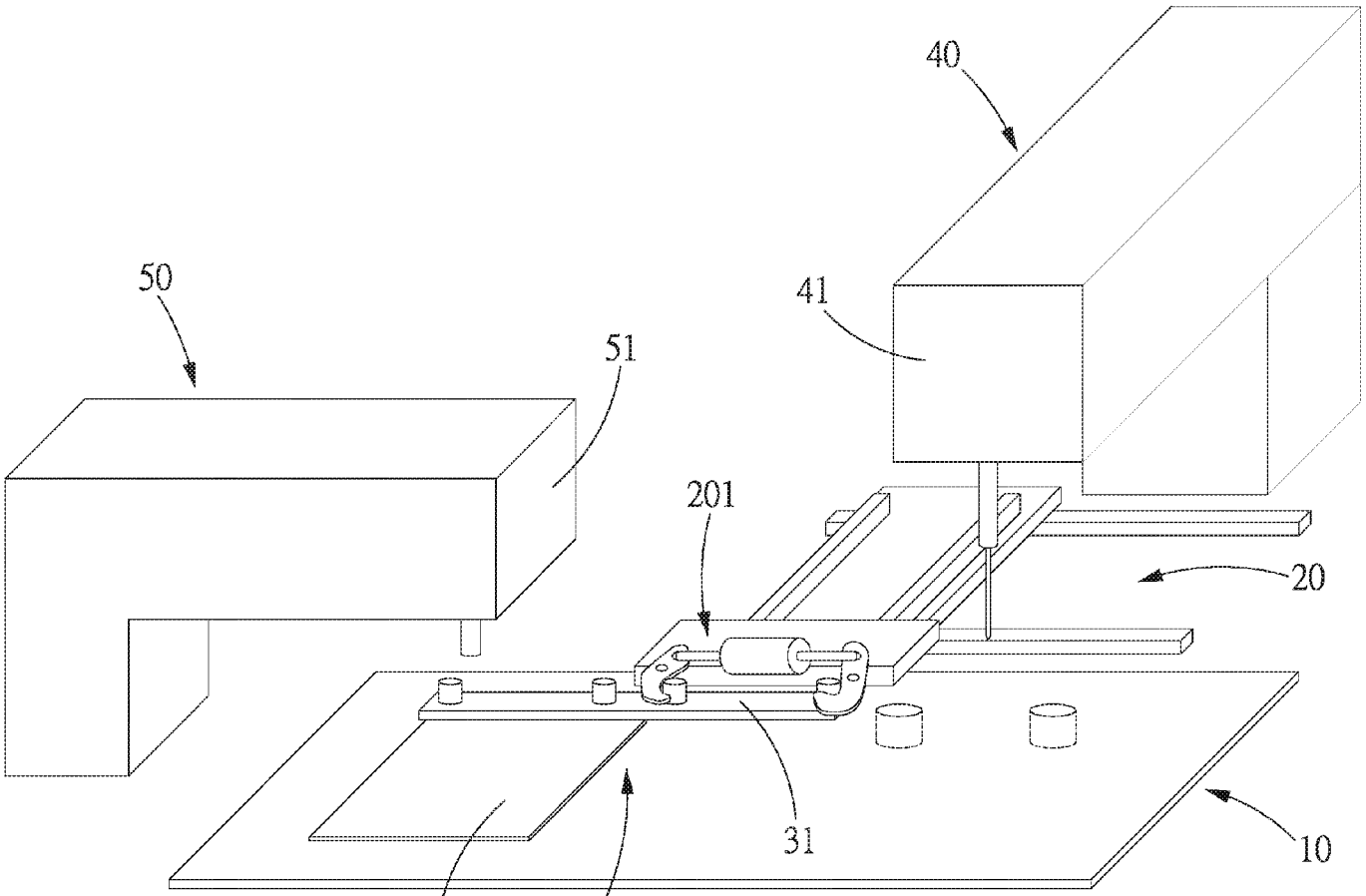
FIG. 1 is a perspective view of the computer-controlled sewing machine of the present invention integrated with an eyelet inserting device.
Figure 2:
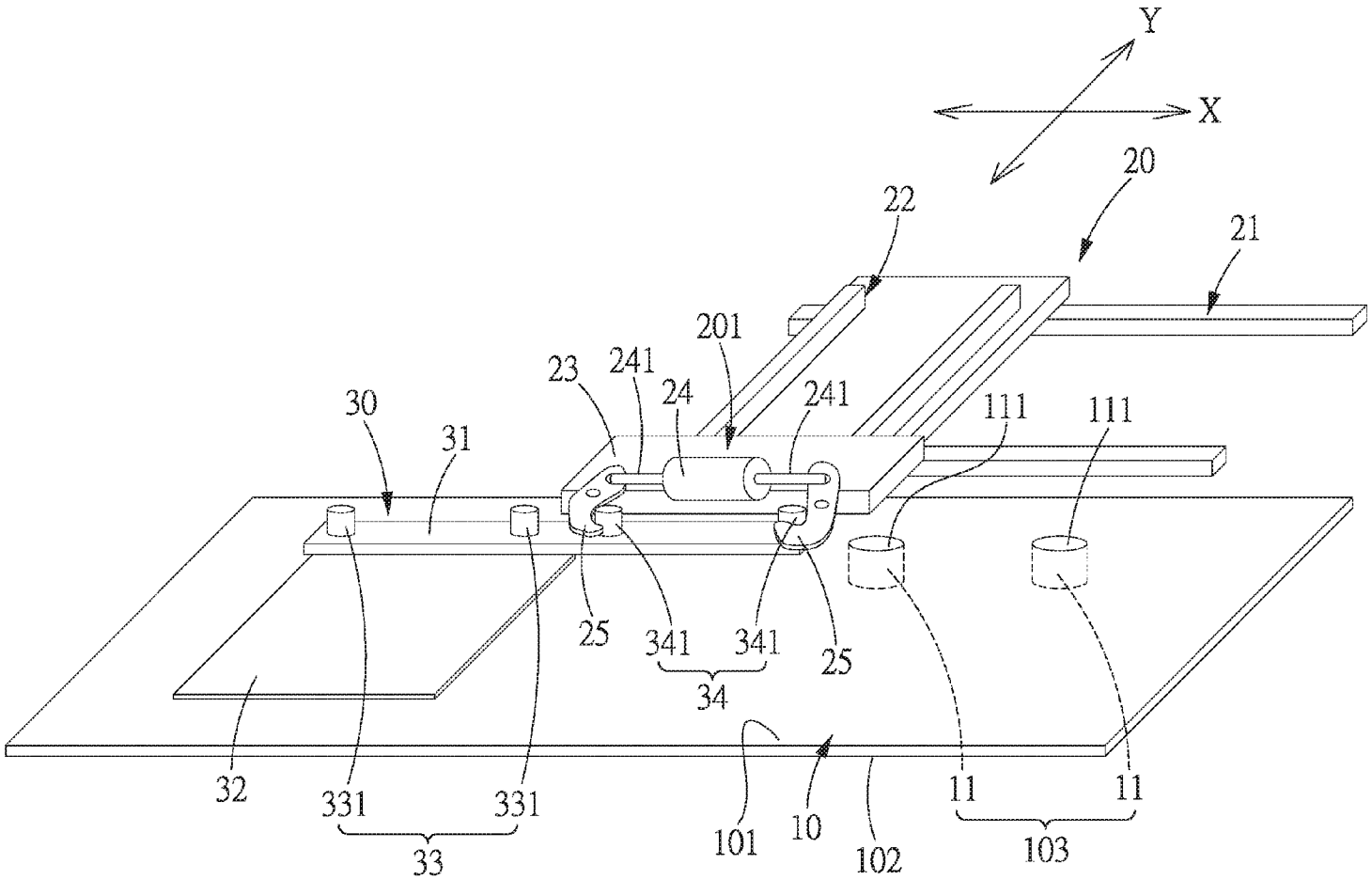
FIG. 2 shows the structure of the clamping device in accordance with the present invention.

| | |
|---|---|
| Work platform 10 | top surface 101 |
| bottom surface 102 | positioning mechanism 103 |
| electromagnet 11 | magnetic surface 111 |
| conveying mechanism 20 | first slide rail assembly 21 |
| second slide rail assembly 22 | clamping device 201 |
| support bracket 23 | piston motor 24 |
| link rod 241 | hook 25 |
| fixing mechanism 30 | rod 31 |
| support plate 32 | first positioning part 33 and a second positioning part 34 |
| positioning protrusion 331 | |
| positioning protrusion 341 | |
| computer-controlled sewing machine 40 | sewing head 41 |
| processing device 50 | processing head 51 |
| direction X | direction Y |
| step S1 of defining the relative distance | |
| step S2 of defining the positioning distance | |
| step S3 of positioning in sewing-operation | |
| step S4 of positioning in processing procedures | |

DETAILED DESCRIPTION

The present invention will be clearer from the following description when viewed together with the accompanying drawings, which show, for purpose of illustrations only, the preferred embodiment in accordance with the present invention.

Referring to FIGS. 1 to 4-4, a computer-controlled sewing machine positioning system integrated with a processing device, and positioning method thereof is shown.

The computer-controlled sewing machine positioning system integrated with a processing device in accordance with the present invention comprises: a work platform 10 equipped with a positioning mechanism 103, a conveying mechanism 20 provided with a clamping device 201, a fixing mechanism 30, a computer-controlled sewing machine 40 and at least one processing device 50.

The work platform 10 includes a top surface 101 and an opposite bottom surface 102, and the positioning mechanism 103 is disposed on the top surface 101. In this embodiment, the positioning mechanism 103 includes two electromagnets 11, and each of the electromagnets 11 includes a magnetic surface 111 which protrudes out of the top surface 101. The fixing mechanism 30 includes a rod 31 which is a magnetically attractive metal rod to be attracted to the two electromagnets 11, so that the fixing mechanism 30 is fixed to the top surface 101 of the work platform 10.

The conveying mechanism 20 is disposed at one side of the work platform 10, and includes a first slide rail assembly 21 extending in a direction X and a second slide rail assembly 22 extending in a direction Y. The clamping device 201 is disposed at one end of the second slide rail assembly 22 facing the work platform 10. In this embodiment, the clamping device 201 includes a support bracket 23 which is fixed to the end of the second slide rail assembly 22 facing the work platform 10. A piston motor 24 is provided on the support bracket 23, and two link rods 241 are disposed at two ends of the piston motor 24 and each has a distal end pivoted to a hook 25, respectively.

The computer-controlled sewing machine 40 is disposed on the work platform 10 and uses a processing program to execute sewing operation and relative processing procedures. The computer-controlled sewing machine 40 includes a sewing head 41 which is disposed above the top surface 101 of the work platform 10.

The at least one processing device 50 is disposed on the work platform 10, and includes a processing head 51. A relative distance is provided between the processing head 51 and the sewing head 41 and located along the work platform 10. In this embodiment, the at least one processing device 50 is selected from the group consisting of eyelet inserting machine, a cementing application gun and a holes punching hammer Between the processing head 51 of each processing device 50 and the sewing head 41 is provided the relative distance which is located along the work platform 10.

The fixing mechanism 30 serves to fix an object to be sewn (not shown), and includes the rod 31 extending in the direction X and a support plate 32 which has a lateral edge fixed to the rod 31. The rod 31 is provided at two ends thereof with a first positioning part 33 and a second positioning part 34, and the first positioning part 33 is located corresponding to the support plate 32. A positioning distance is provided between the first and second positioning parts 33, 34. In this embodiment, the first positioning part 33 includes a pair of positioning protrusions 331, and the second positioning part 34 includes a pair of positioning protrusions 341. The two link rods 241 are driven by the piston motor 24 to make the hooks 25 release or clamp the positioning protrusions 331, 341 of the fixing mechanism 30, so that the fixing mechanism 30 is abutted against the support bracket 23 and driven by the conveying mechanism 20 to move on the work platform 10 to a position below the sewing head 41 or the processing head 51.

The positioning mechanism 103, the conveying mechanism 20, the clamping device 201 and the processing device 50 are electrically connected to the computer-controlled sewing machine 40 and controlled to operate by the processing program. The processing program controls the positioning mechanism 103 to fix the fixing mechanism 30 to the work platform 10 and make the clamping device 201 selectively clamp the first positioning part 33 or the second positioning part 34, and the fixing mechanism 30 is driven by the conveying mechanism 20 to move on the work platform 10. The processing program can calculate the accurate movement distance of the fixing mechanism 30 between the sewing head 41 or the processing head 51 by using the positioning distance and the relative distance.

In this embodiment, the positioning distance between the first and second positioning parts 33, 34 of the fixing mechanism 30 is equal to the relative distance between the processing head 51 of the processing device 50 and the sewing head 41 of the computer-controlled sewing machine 40, so that position coordinates can be obtained to move the fixing mechanism 30 between the sewing head 41 and the processing head 51.

What mentioned above are the structure relations of the main components of the embodiment, for a better understanding of the function and operation of the present invention, reference should be made to the following description when taken into conjunction with FIGS. 1 to 4-4.

Figure 3:
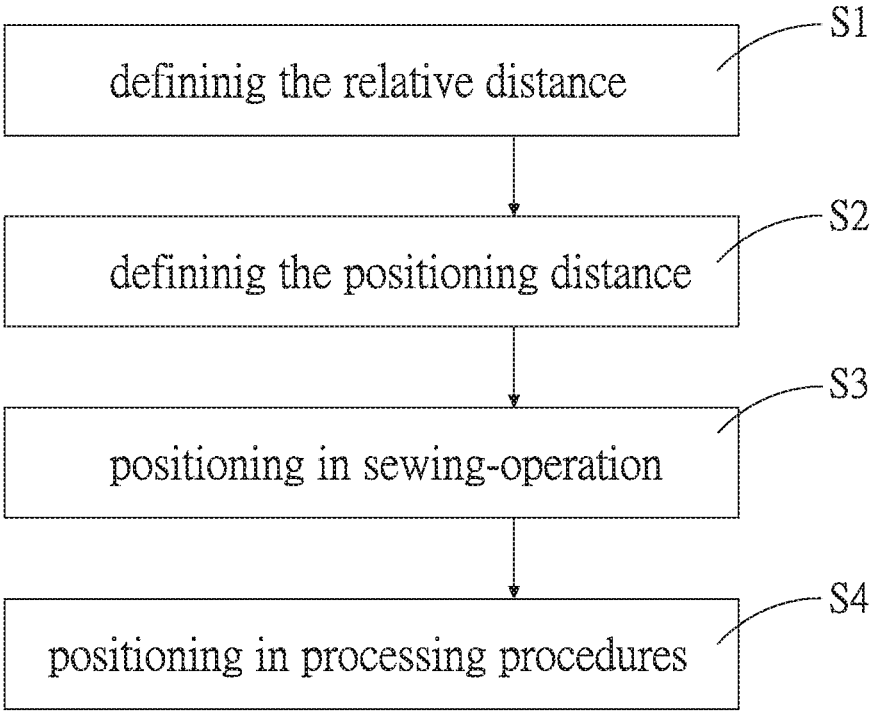
FIG. 3 is a flow chart view showing the positioning method of the computer-controlled sewing machine positioning system.

The positioning method of the computer-controlled sewing machine positioning system in accordance with the present invention is used in the sewing operation and the processing procedures integrated with the sewing operation. As shown in FIG. 3, the positioning method includes the following steps: a step S1 of defining the relative distance, a step S2 of defining the positioning distance, a step S3 of positioning in sewing-operation, and a step S4 of positioning in processing procedures. The step S3 and the step S4 can be swapped. There is a method for changing the position of the fixing mechanism between the steps S3 and S4.

The step S1 of defining the relative distance includes locating the processing device 50 in a position which is precisely defined and located at a distance from the sewing head 41 of the computer-controlled sewing machine 40, defining a distance between the processing head 51 and the sewing head 41 along the work platform 10 as a relative distance, and presetting the relative distance in the processing program of the computer-controlled sewing machine 40.

The step S2 of defining the positioning distance includes presetting the first positioning part 33 and the second positioning part 34 on the rod 31 of the fixing mechanism 30, defining the distance between the first and second positioning parts 33, 34 as the positioning distance, presetting the positioning distance in the processing program of the computer-controlled sewing machine 40.

The step S3 of positioning in sewing-operation includes using the clamping device 201 to clamp the first positioning part 33 of the fixing mechanism 30, abutting the fixing mechanism 30 against the support bracket 23, moving, by the conveying mechanism 20, the fixing mechanism 30 to a position below the sewing head 41.

The step S4 of positioning in processing procedures includes sending, by the processing program, an instruction to the conveying mechanism 20 to make the clamping device 201 clamp against the fixing mechanism 30 when the processing program determines the positioning distance with respect to the relative distance, finding coordinates where the relative distance and the positioning distance are equal, so that, based on the coordinates, the fixing mechanism 30 can be moved precisely from the position below the sewing head 41 to a position below the processing head 51 to perform processing procedures.

Figures 1, 4:
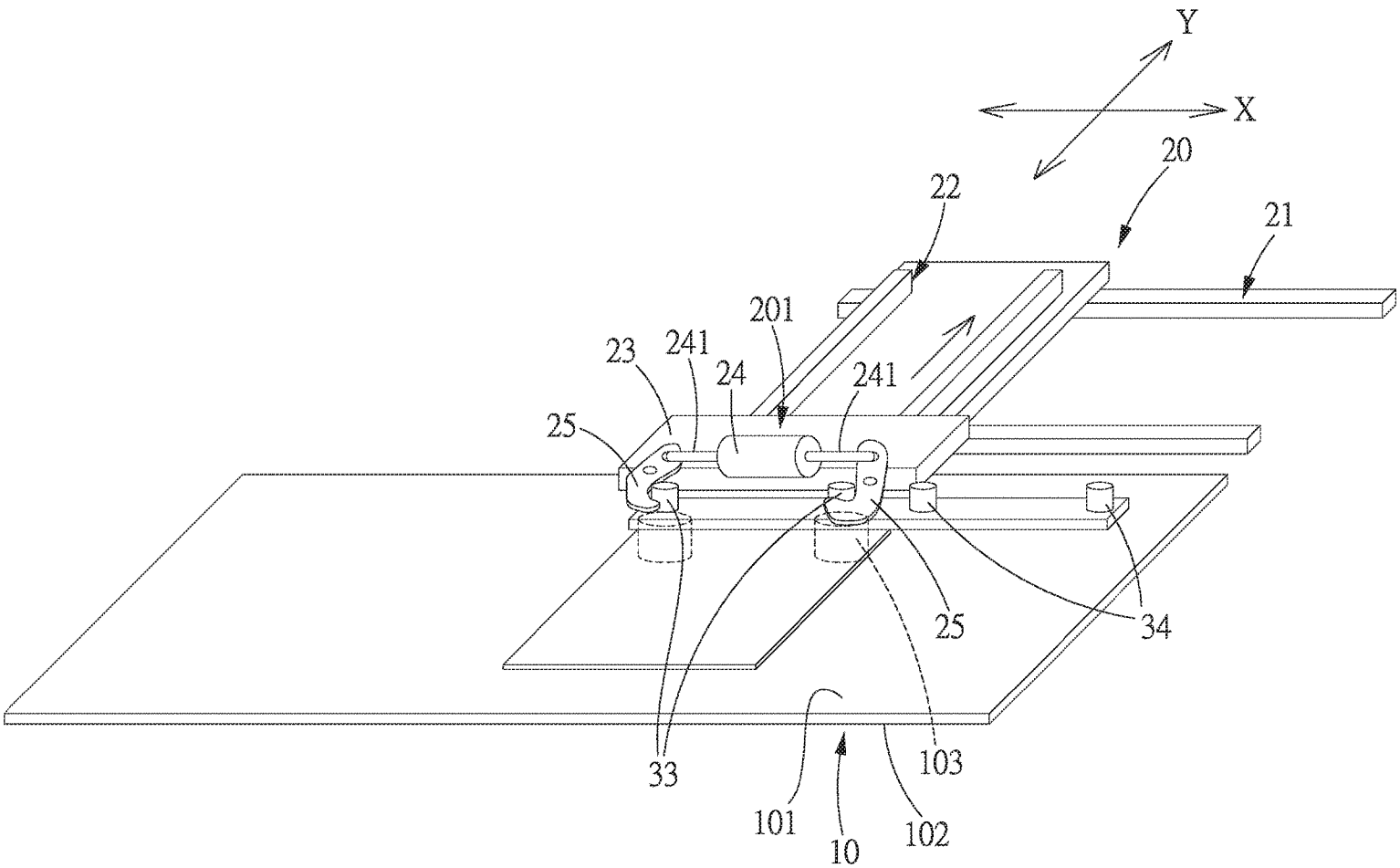
Figures 2, 4:
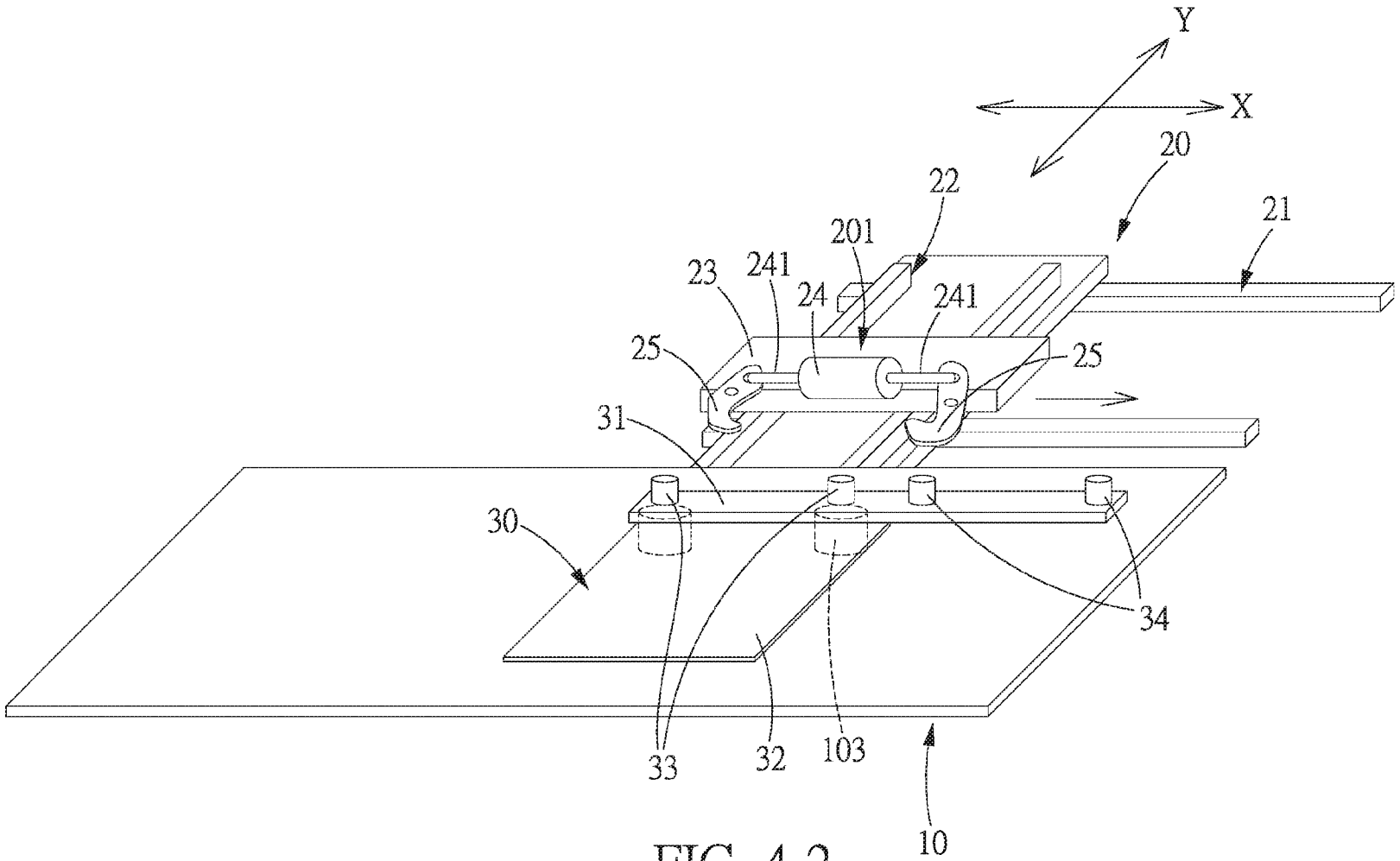
Figures 3, 4:
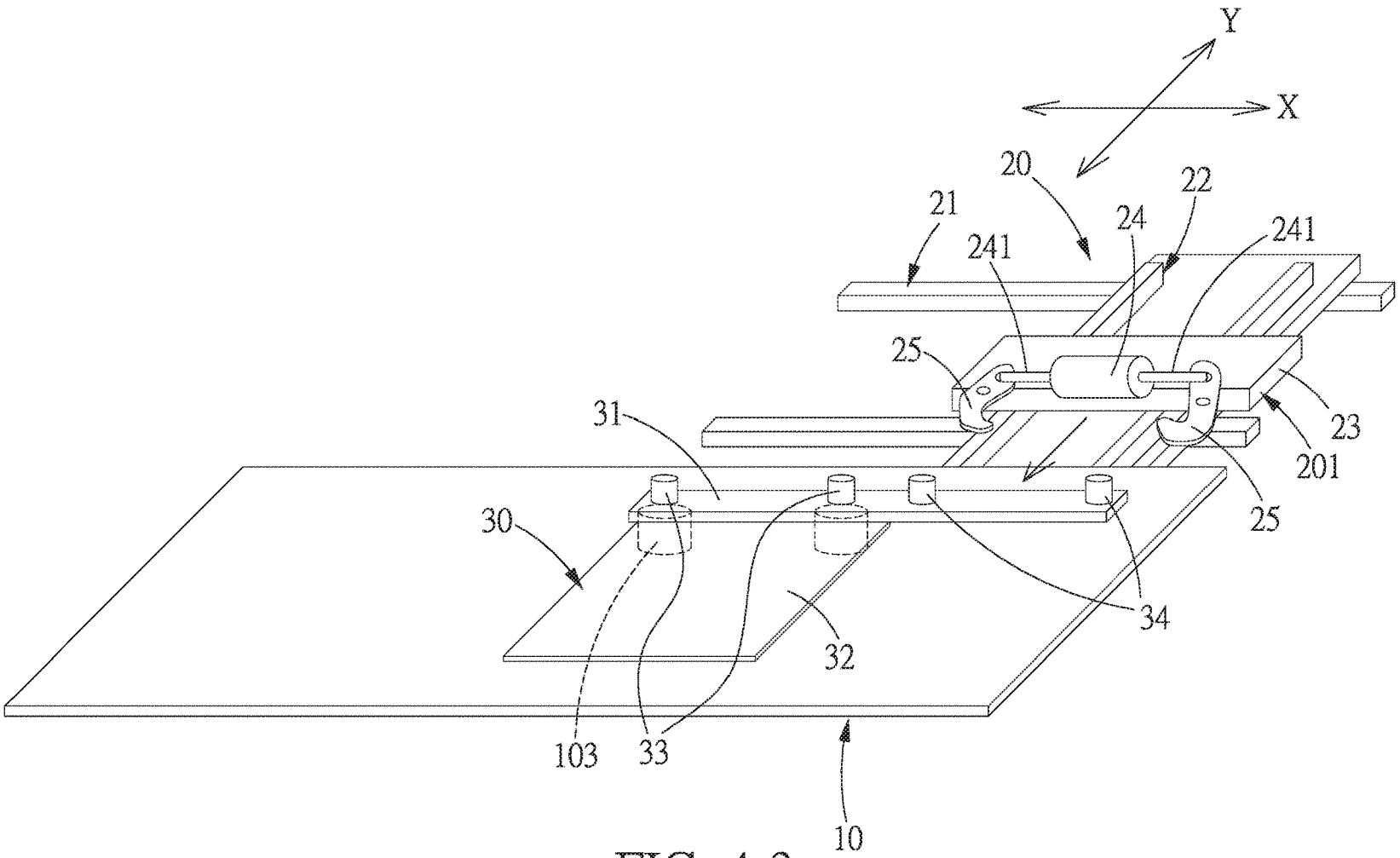
Figure 4:
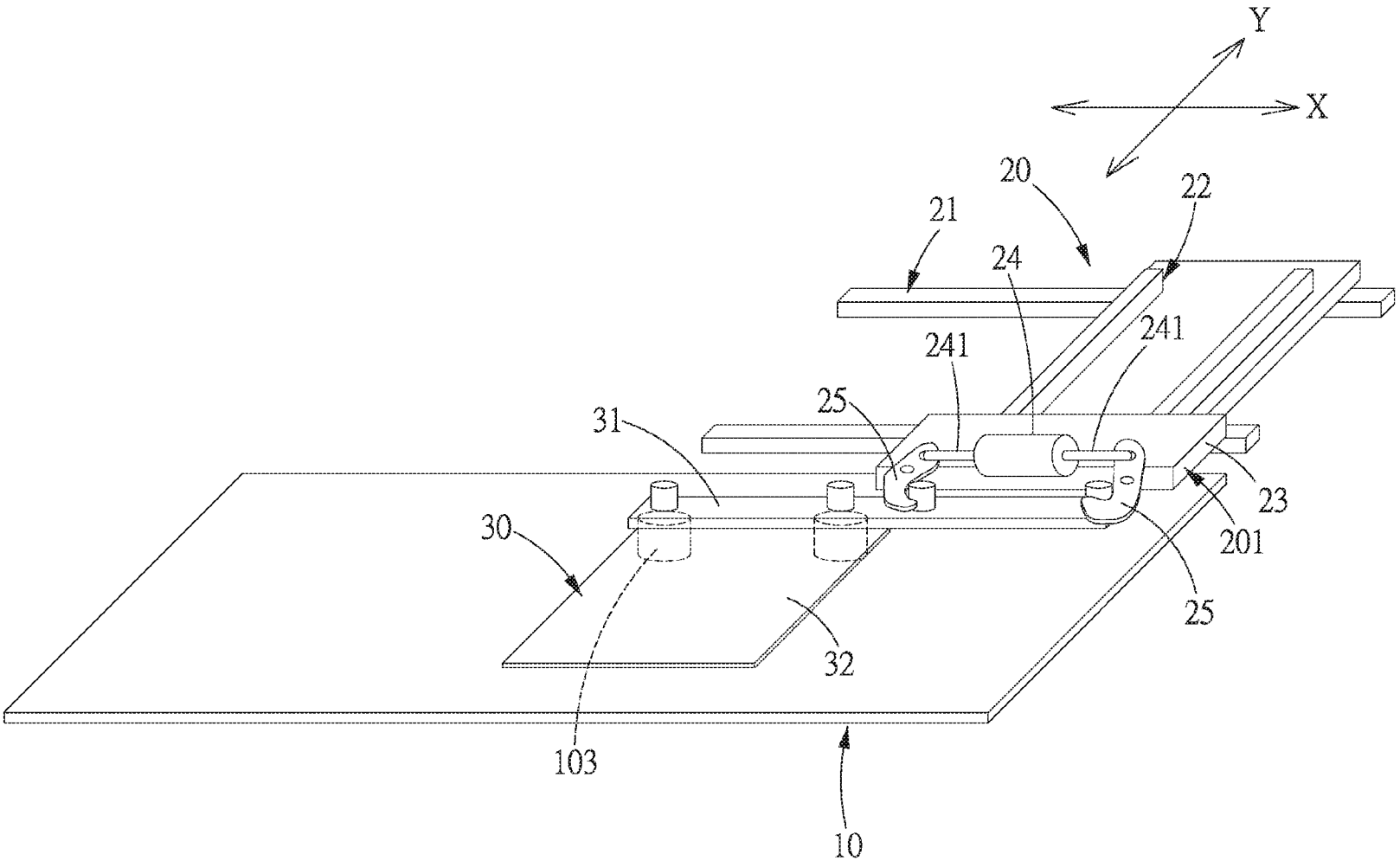

More specifically, as shown in FIGS. 4-1 to 4-4, the method for changing the position of the fixing mechanism includes: moving, when the processing device 50 is turned on, the fixing mechanism 30 to a position where the rod 31 and the positioning mechanism 103 are aligned in a vertical direction, at this moment, the clamping device 201 is clamped against one of the first and second positioning parts 33, 34 to turn on the positioning mechanism 103, so that the positioning mechanism 103 produces magnetic force to attract the rod 31, consequently the fixing mechanism 30 is fixed to the work platform 10; then making the piston motor 24 releases the hooks 25, pivoting the hooks 25 to disengage from one of the first and second positioning parts 33, 34, moving, by the conveying mechanism 20, the clamping device 201 in the direction Y to release from the fixing mechanism 30, moving the clamping device 201 in the direction X to another one of the first and second positioning parts 33, 34, moving the clamping device 201 in the direction Y to the another one of the first and second positioning parts 33, 34; making the clamping device 201 clamp the another one of the first and second positioning parts 33, 34, making the positioning mechanism 103 stop attracting the rod 31, so that the fixing mechanism 30 is released, then the piston motor 24 makes the hooks 25 hook the another one of the first and second positioning parts 33, 34, so that the fixing mechanism 30 is abutted against the support bracket 23 of the clamping device 201, and therefore can be driven by the clamping device 201 and the conveying mechanism 20 to move on the work platform 10.

With the abovementioned structure, the fixing mechanism 30 is allowed to move within the offset distance between the first and second positioning parts 33, 34, and there is a same offset distance (which is equal to the offset distance between the first and second positioning parts 33, 34) between the processing device 50 which is fixed on the work platform 10 and the computer-controlled sewing machine 40. By such arrangements, the coordinates of the position of the sewing head 41 can be converted into the coordinates of the position of the processing head 51. Therefore, the sewing operation and the relative processing procedures, such as the inserting of eyelets or application of cement, can use the same coordinate system to position the to-be-processed object, which avoids the problems caused when the sewing machine and other processing devices are used separately.

While we have shown and described various embodiments in accordance with the present invention, it is clear to those skilled in the art that further embodiments may be made without departing from the scope of the present invention.

What is claimed is:

1. A computer-controlled sewing machine positioning system integrated with a processing device, comprising:

a work platform including a top surface, an opposite bottom surface, and a positioning mechanism disposed on the top surface;

a conveying mechanism disposed at one side of the work platform, and including a first slide rail assembly extending in a direction X and a second slide rail assembly extending in a direction Y, a clamping device being disposed at one end of the second slide rail assembly facing the work platform;

a computer-controlled sewing machine disposed on the work platform and including a processing program, and further including a sewing head which is disposed above the top surface of the work platform;

at least one processing device disposed on the work platform, and including a processing head, a relative distance being provided between the processing head and the sewing head and located along the work platform; and a fixing mechanism serving to fix an object to be sewn, and including a rod extending in the direction X and a support plate which has a lateral edge fixed to the rod, the rod being provided at two ends thereof with a first positioning part and a second positioning portion, and a positioning distance being provided between the first and second positioning portions;

wherein the positioning mechanism, the conveying mechanism, the clamping device and the processing device are electrically connected to the computer-controlled sewing machine and controlled to operate by the processing program, the processing program controls the positioning mechanism to fix the fixing mechanism to the work platform and make the clamping device selectively clamp the first positioning part or the second positioning portion, and the fixing mechanism is driven by the conveying mechanism to move on the work platform, so that the processing program is able to calculate a movement distance of the fixing mechanism between the sewing head or the processing head by using the positioning distance and the relative distance.

2. The computer-controlled sewing machine positioning system as claimed in claim 1, wherein the clamping device is disposed at one end of the second slide rail assembly facing the work platform, a piston motor is provided on the support bracket, and two link rods are disposed at two ends of the piston motor and each has a distal end pivoted to a hook, respectively;

each of the first and second positioning parts includes a pair of positioning protrusions;

the two link rods are driven by the piston motor to make the hooks release or clamp the positioning protrusions of the fixing mechanism, so that the fixing mechanism is abutted against the support bracket and driven by the conveying mechanism to move on the work platform to a position below the sewing head or the processing head.

3. The computer-controlled sewing machine positioning system as claimed in claim 1, wherein the positioning mechanism includes two electromagnets, and each of the electromagnets includes a magnetic surface which protrudes out of the top surface, the rod of the fixing mechanism is a magnetically attractive metal rod to be attracted to the two electromagnets, so that the fixing mechanism is fixed to the top surface of the work platform.

4. The computer-controlled sewing machine positioning system as claimed in claim 1, wherein the at least one processing device is selected from the group consisting of eyelet inserting machine, a cementing application gun and a holes punching hammer, the relative distance is provided between the processing head of the processing device and the sewing head and located along the work platform.

5. The computer-controlled sewing machine positioning system as claimed in claim 1, wherein the positioning distance between the first and second positioning parts of the fixing mechanism is equal to the relative distance between the processing head of the processing device and the sewing head of the computer-controlled sewing machine, so that position coordinates are obtained to move the fixing mechanism between the sewing head and the processing head.

6. A positioning method of the computer-controlled sewing machine positioning system as claimed in claim 1, being used in the sewing operation and the processing procedures integrated with the sewing operation, characterized in that, the positioning method comprises:

a step of defining the relative distance including: locating the processing device in a position which is precisely defined and located at a distance from the sewing head of the computer-controlled sewing machine, defining a distance between the processing head and the sewing head along the work platform as the relative distance, and presetting the relative distance in the processing program of the computer-controlled sewing machine;

a step of defining the positioning distance including: presetting the first positioning part and the second positioning part on the rod of the fixing mechanism, defining a distance between the first and second positioning parts as the positioning distance, presetting the positioning distance in the processing program of the computer-controlled sewing machine;

a step of positioning in sewing-operation including: using the clamping device to clamp the first positioning part of the fixing mechanism, abutting the fixing mechanism against the support bracket, moving, by the conveying mechanism, the fixing mechanism to a position below the sewing head; and a step of positioning in processing procedures including: sending, by the processing program, an instruction to the conveying mechanism to make the clamping device clamp against the fixing mechanism when the processing program determines the positioning distance with respect to the relative distance, finding coordinates where the relative distance and the positioning distance are equal, so that, based on the coordinates, the fixing mechanism is moved from the position below the sewing head to a position below the processing head to perform processing procedures.

7. The positioning method as claimed in claim 1, wherein the step of positioning in sewing-operation and the step of positioning in processing procedures can be swapped, there is a method for changing the position of the fixing mechanism between the step of positioning in sewing-operation and the step of positioning in processing procedures, the method for changing the position of the fixing mechanism including:

turning on the positioning mechanism, when the clamping device clamps one of the first and second positioning portions, to fix the fixing mechanism to the work platform;

making the clamping device release the one of the first and second positioning portions;

moving, by the conveying mechanism, the clamping device in the direction Y to release from the fixing mechanism, moving the clamping device in the direction X to another one of the first and second positioning portions, moving the clamping device in the direction Y to the another one of the first and second positioning portions;

making the clamping device clamp the another one of the first and second positioning portions, making the positioning mechanism stop working, so that the fixing mechanism is allowed to be driven by the clamping device and the conveying mechanism to move on the work platform.

* * * * *